US005406652A

United States Patent [19]

Hennessy

[11] Patent Number: 5,406,652

[45] Date of Patent: Apr. 18, 1995

[54] TOILET WATER SOURCE

[75] Inventor: Arnold Hennessy, Wellington, Canada

[73] Assignee: Fluidmaster Inc., Anaheim, Calif.

[21] Appl. No.: 55,821

[22] Filed: Apr. 30, 1993

[51] Int. Cl.[6] ..... E03D 3/10

[52] U.S. Cl. ..... 4/354; 4/361; 4/362; 4/332

[58] Field of Search ..... 4/320, 329, 332, 354, 4/355, 356, 357, 358, 359, 360, 361, 362

[56] References Cited

U.S. PATENT DOCUMENTS

| | | | |
|---|---|---|---|
| 516,129 | 5/1894 | Stifel | 4/328 |
| 530,306 | 12/1894 | Harvey | 4/328 |
| 575,111 | 6/1897 | Harvey | 4/328 |
| 2,793,793 | 5/1957 | Sampson | 4/354 |
| 3,095,577 | 7/1963 | Clark | 4/325 |
| 3,817,489 | 6/1974 | Caron et al. | 4/359 |
| 4,115,883 | 9/1978 | Dauvergne | 4/362 |
| 4,232,409 | 11/1980 | Van Pham | 4/362 |
| 4,407,025 | 10/1983 | Hennessy et al. | 4/332 |
| 4,707,868 | 11/1987 | Hennessy | 4/361 |
| 5,005,226 | 4/1991 | Basile et al. | 4/354 |
| 5,073,494 | 12/1991 | Sargent et al. | 4/332 |

FOREIGN PATENT DOCUMENTS

| | | | |
|---|---|---|---|
| 788 | of 1887 | United Kingdom | 4/356 |
| 8775 | of 1892 | United Kingdom | 4/357 |
| 396960 | 8/1933 | United Kingdom | 4/354 |
| 1054367 | 1/1967 | United Kingdom | 4/328 |
| 1093277 | 11/1967 | United Kingdom | 4/354 |

*Primary Examiner*—Henry J. Recla
*Assistant Examiner*—Charles R. Eloshway
*Attorney, Agent, or Firm*—Freilich Hornbaker Rosen

[57] ABSTRACT

A water source (12, FIG. 1) is provided for mounting on a toilet housing (32) rearward of the toilet bowl (18), which has a small rearward-to-forward depth (D) and low height (H), and which enables close control of the flow of water and any vacuum to the toilet bowl and its outlet. The source includes a frame (40) for mounting on the rearward portion of the toilet housing, the frame having two wide holes (50, 52) and a diaphragm device (54, 56) extending across each hole to separate water regions (60, 62) from air regions (64, 66) that lie on opposite sides of the diaphragm. The holes and diaphragms form two horizontally spaced water supply units 42, 44 that lie on opposite sides of the toilet bowl outlet 24 to efficiently use space. A spring or weight biases each diaphragm to compress the water region. The two water regions are connected together and to a flush valve (14) for supplying water to the toilet bowl. Where a vacuum assisted toilet is used, at least one of the air region is connected to the toilet bowl outlet (24) to apply a vacuum thereto when water flows out of the water regions.

5 Claims, 7 Drawing Sheets

FIG. 1
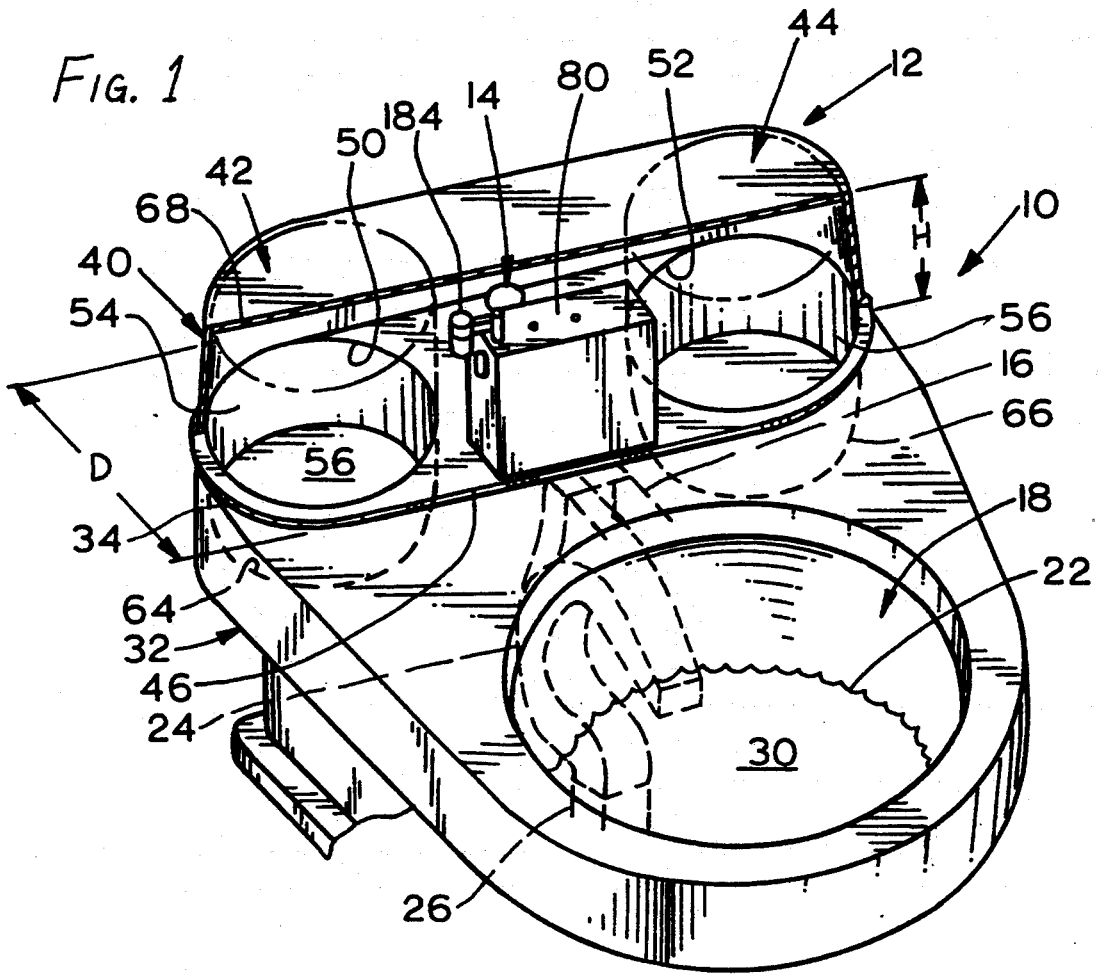
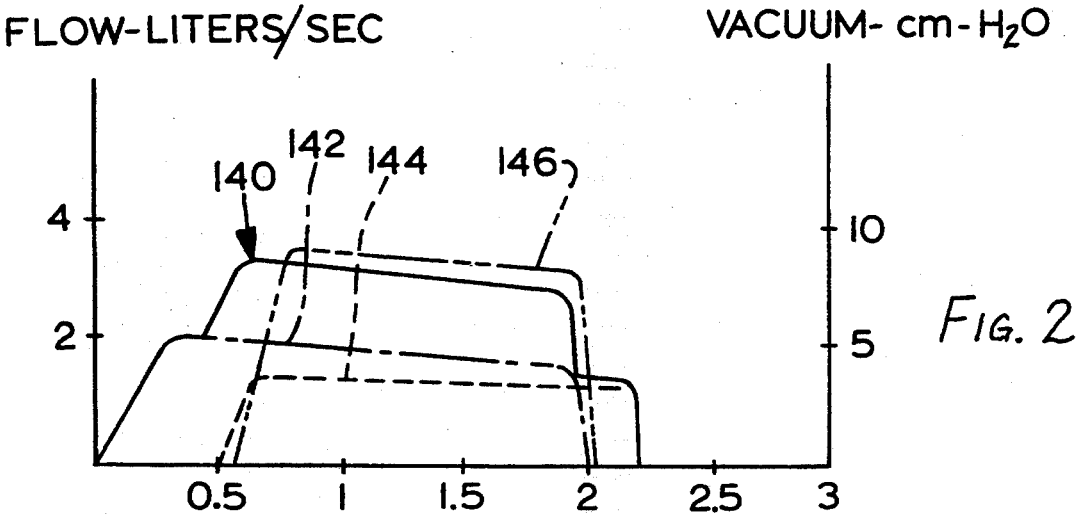
FIG. 2

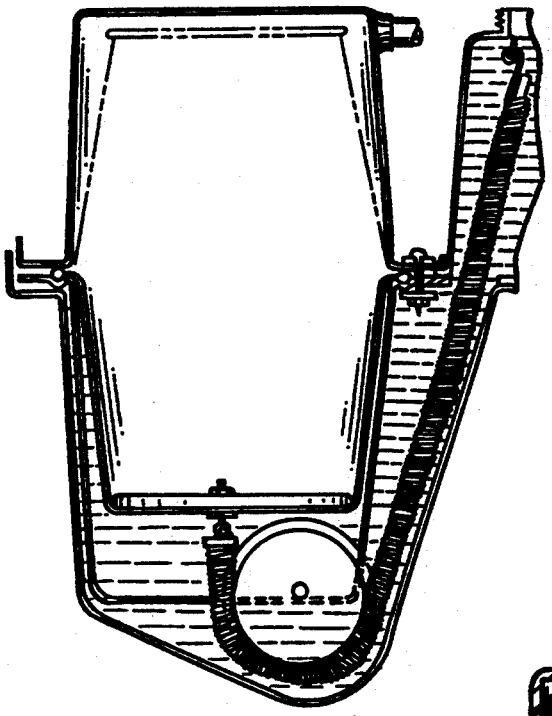
FIG. 12
FIG. 14
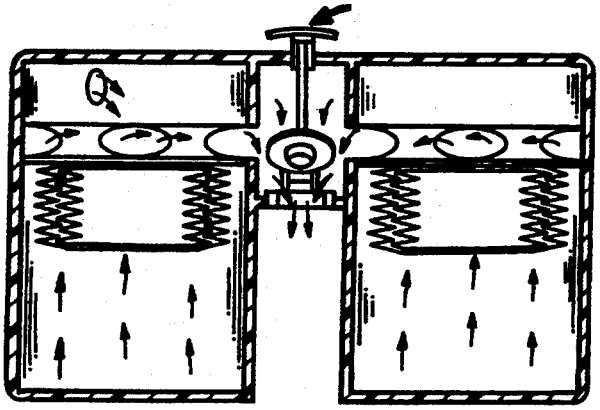
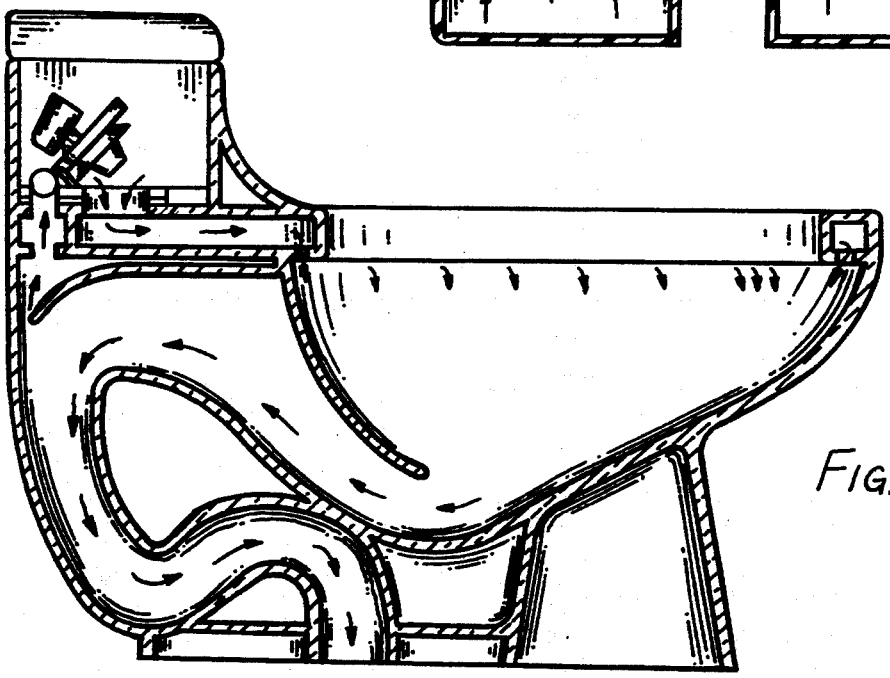
FIG. 13

TOILET WATER SOURCE

BACKGROUND OF THE INVENTION

The amount of water required in each effective flushing of a toilet, can be reduced by flowing water rapidly into the toilet bowl at the beginning of a flushing. This is conventionally accomplished by storing water in a water closet of substantial height such as fifteen inches (37.5 cm) above the level of the top of the toilet bowl. However, toilets of "low profile" require that the water closet area be of low height to enhance the overall appearance of the toilet. Such "low profile" toilets often must have only a small rearward extension behind the toilet bowl, such as one that is no more than about seven inches (17 cm) behind the location where the toilet bowl cover is mounted. Even low water usage toilets require perhaps 1.5 gallons (6 liters) of water, which is difficult to accommodate in a reliable pressure source in the small depth available. A water source which could supply water at a moderate pressure such as at least twelve inches (30 cm) of water pressure and preferably more than that, and which could be accommodated in a small volume of a depth such as seven inches (17 cm) behind the toilet bowl while providing room for the toilet outlet, would be of considerable value.

One type of water saver toilet applies a vacuum to the toilet bowl outlet to help draw water and debris out of the bowl. A water source which could supply pressured water to the toilet bowl during a flushing, and which could apply a vacuum in a controlled manner, would be of considerable value.

SUMMARY OF THE INVENTION

In accordance with one embodiment of the present invention, a pressured water source is provided for use with toilets, which can be mounted in a volume of small height and forward-to-rearward depth in a toilet housing. The water source includes a pair of pressured water supply units, each including a bellows or diaphragm which forms a water chamber region and an air chamber region on opposite sides of the diaphragm. The water regions are both connected to a flush valve device so they both expel water through the flush valve into the toilet bowl during a flushing. A biasing device in the form of a spring or weight, is coupled to each diaphragm to urge compression of the corresponding water chamber region, to provide pressured water that flows rapidly out through the flush valve device into the toilet bowl at the beginning of a flushing. The water supply units can lie on opposite sides of the toilet bowl outlet, to occupy space that does not detract from the appearance of the toilet.

The source is useful in a vacuum assisted toilet wherein a vacuum is applied to a trapway of the toilet bowl outlet, the trapway lying between upper and lower traps of the toilet bowl outlet. At least one of the air chamber regions is coupled to the trapway to apply a vacuum thereto as the corresponding diaphragm moves to compress the volume of the water region and expand the air region. The vacuum regions can be isolated from each other, and only the second one coupled to the trapway, with the second diaphragm biased by a softer spring than the first diaphragm, to delay the application of a vacuum to the trapway, and to limit the magnitude of the vacuum.

The two chambers can be formed on a single frame on which is mounted the diaphragm, an inlet valve for supplying water to the water chamber regions, and the flush valve.

The intensity (negative pressure) of the vacuum is closely controlled for a gravity (non-pressured) toilet as well as for one that uses a pressured water source. A vacuum level of between 3.5 and 5 inches (8.9 cm to 12.7 cm) of water is maintained in the trapway immediately after the lower trap is closed and until about the time that the lower trap is opened.

A flush valve member can include a pressure relief valve thereon, which opens at a predetermined pressure to prevent bursting of the pressured water source if there is a malfunction. The pressure relief valve passes water down through the valve seat of the flush valve. The flush valve can include a soft elastomeric outer end which is peeled off the valve seat to facilitate opening of the flush valve.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial isometric view of a toilet constructed in accordance with the present invention.

FIG. 2 includes graphs showing variation of water flow rate with time, of water flow into the toilet bowl, and variation of vacuum intensity with time, of the vacuum in the trapway of the toilet bowl outlet, for the toilet of FIG. 1.

FIG. 12 is a front view of the flush valve of FIG. 11, during an early state of its operation.

FIG. 13 is a partial sectional view of one of the units of the water-and-vacuum source of FIG. 8.

FIG. 14 is a simple sectional side view of the toilet of FIG. 8, in the middle of a flushing.

DESCRIPTION OF THE PREFERRED EMBODIMENTS

Figure 3:
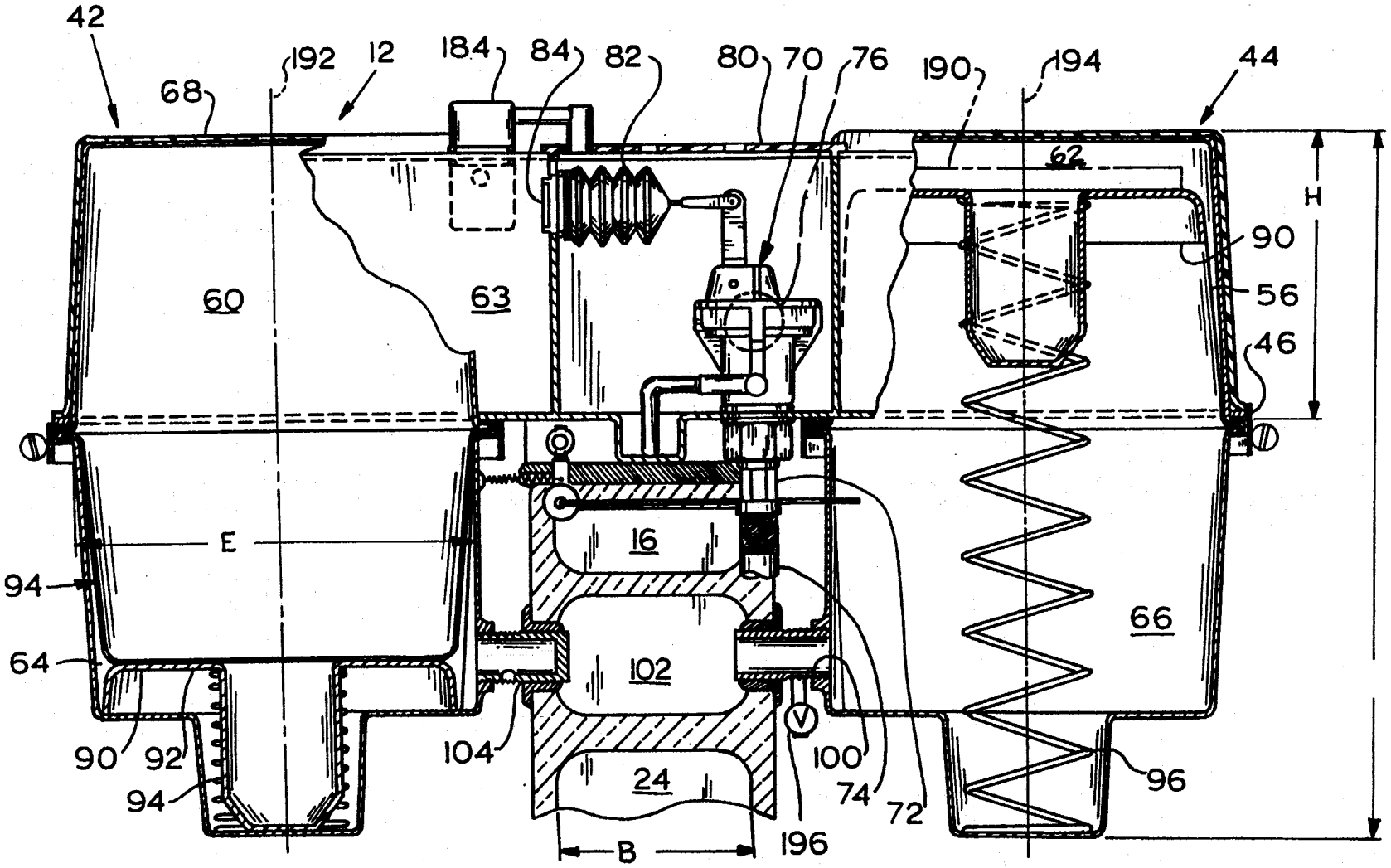
FIG. 3 is a sectional front view of the water source of the toilet of FIG. 1, with the left side showing the water region of the first unit completely filled and with the right side showing the water region of the second unit substantially empty.

FIG. 1 illustrates a low profile toilet 10 which includes a water source 12 that contains flush water. When a person operates a flush lever or button (not shown) a flush valve device or flush valve 14 opens and allows water stored in the water source 12 to flow through a flush conduit or water tunnel 16 into a toilet bowl 18. Water flushed into the toilet bowl raises the water level from an initial level 22, to cause water and any debris in the toilet bowl to flow out of a toilet bowl outlet 24 that carries water and waste to a drain 26 that connects to a sewer system. At the beginning of a flushing, when the flush valve 14 first opens, water must flow rapidly into the toilet bowl to rapidly raise the level therein so as to "push" the previous "slug" of water and waste as a unit into the toilet bowl outlet. During a period of perhaps forty-five seconds after a flushing, water from a household water supply flows into the water source 12 to refill it and ready it for the next flushing. During refill of the water source, the inlet valve flows some water through the flush conduit 16 into the toilet bowl to refill it to the initial level 22. In large cities, the supply pressure of water is always more than 1 psi (7 kilo Pascal or 7 kPa) and is usually much more than 20 psi (143 kPa).

The particular toilet 10 is a vacuum assisted type, wherein the water source applies a vacuum to the toilet bowl outlet 24 during each flushing, to help draw water and waste from the water pool 30 in the toilet bowl, to efficiently flush it with a minimum of water. However, the water source 12 can be used in a toilet without vacuum assist.

The toilet 10 includes a toilet housing 32 with a forward portion forming the toilet bowl 18, and with a rearward portion 34 designed to support the water source 12. "Low profile" toilets, which save space and are considered to be attractive, have a rearward portion of low depth D in a forward-to-rearward direction so the toilet does not occupy a lot of space in a bathroom. Also, such toilets preferably have a low height H above the level of the top of the toilet housing and of its bowl. In the past, it has been difficult to provide a water source of sufficient capacity such as 1.5 gallons (6 liters) which can fit into a space of low depth D and height H, and yet which can supply water at considerable pressure such as the pressure of water at a height of at least one foot (30 cm) to rapidly fill the toilet bowl at the beginning of a flushing. Any such water source must still leave room for the toilet bowl outlet 24 which is molded into the toilet housing 32.

In accordance with the present invention, the water source 12 includes a body or frame 40 with two pressured water supply units 42, 44 formed by the water source. The frame includes a mount plate 46 which mounts on the toilet housing. The mount plate has first and second substantially circular holes 50, 52. A bellows, diaphragm or the like 54, 56, which can be referred to as a diaphragm or diaphragm device, extends across each hole. The diaphragm devices 54, 56 shown in FIG. 1, are shown in their downwardly bowed configuration, wherein a center portion 56 of each diaphragm device is downwardly depressed. Each diaphragm device is upwardly biased by a spring, so that when the flush valve 14 opens, the diaphragm devices are forced upwardly to apply water under pressure to the flush valve 14 for flow to the toilet bowl.

FIG. 3 shows details of the water source 12 and of each of the water supply units 42, 44 thereof. The diaphragm device 54, 56 of each unit divides the volume of the unit into water chamber regions 60, 62 and air chamber regions 64, 66. The first diaphragm device 54 is shown in its downwardly bowed configuration wherein the water region 60 is filled to its maximum volume with water while the air region 64 is at minimum volume. The second diaphragm device 56 is shown upwardly bowed, wherein its water region 62 is at minimum volume and its air region 66 is at maximum volume. In actuality, both diaphragm devices would be downwardly bowed prior to a flushing, would both move upwardly during a flushing and thereby contract the corresponding water chamber regions 60, 62, and would be moved downwardly again after a flushing when water refills the water source and thereby expands the water chamber regions 60, 62. A bellows-type diaphragm device may not be bowed in opposite directions.

Figure 4:
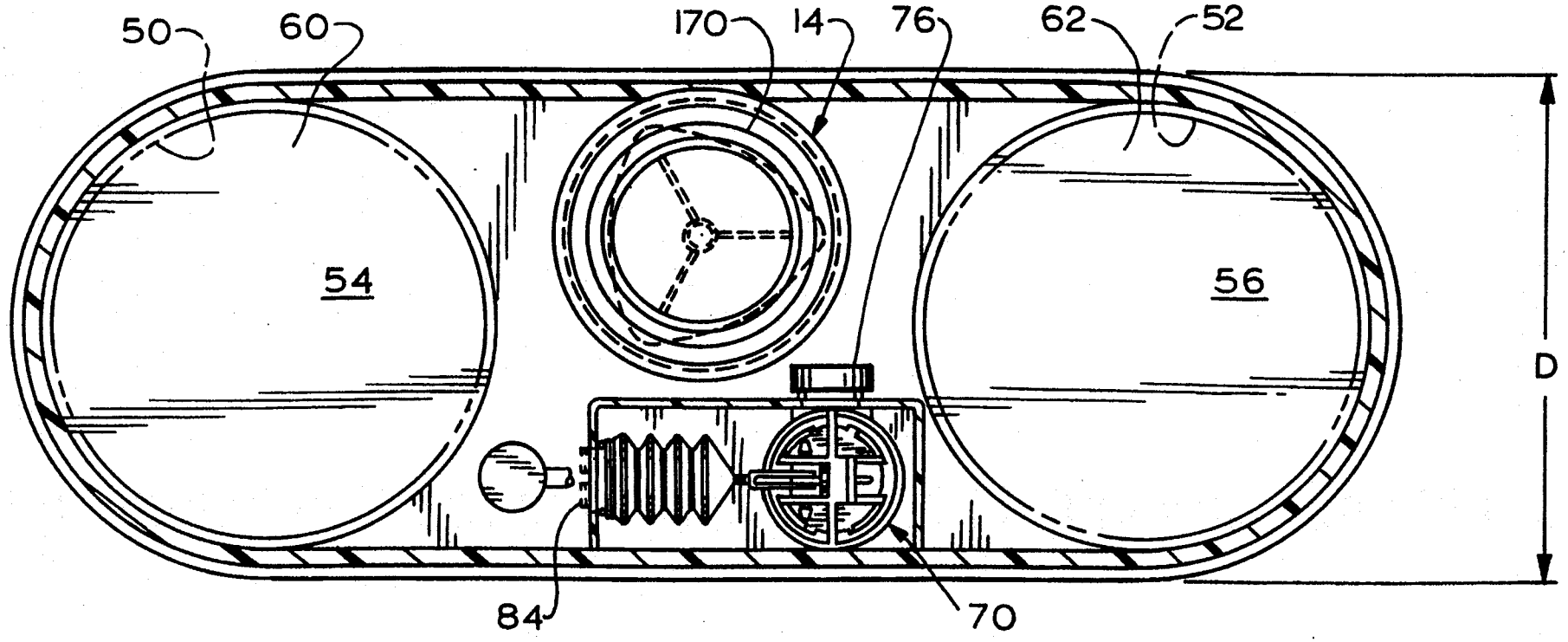
FIG. 4 is a sectional plan view of the water source of FIG. 3.

As indicated in FIG. 1, the two water regions of the two water supply units 42, 44 are connected together and to the flush valve 14. An enclosure 68 encloses all pressured water. In the construction shown in FIG. 1, the upper portion of each unit, above the mount plate 46, is enclosed by an angle of only 180° as seen in a plan view, with the other 180° open to the rest of the water-holding region 69 of the enclosure. FIG. 4 shows the wide area connection of the volumes, above the diaphragm devices 54, 56 (the water regions 60, 62), to each other and to the flush valve 14.

The water source includes an inlet valve 70 shown in FIG. 3, which has an inlet 72 connected to a pressured water supply 74 such as a municipal water supply that supplies water at a considerable pressure, which is always over 1 psi (7 kPa) and usually over 20 psi (143 kPa). The inlet valve has an outlet 76 which delivers water to the water regions 60, 62 and to the space 63 between them, which are all parts of the water-holding region 69. The inlet valve lies in a valve enclosure or box 80 whose internal pressure is the same as the atmospheric pressure of the environment. The inlet valve is operated by a bellows actuator 82 whose inside is open at 84 to the sealed enclosure coupled to the water regions 60, 62 and whose outside is exposed to atmospheric pressure in the box. When the pressure of water in the water regions 60, 62 reaches a predetermined level such as 1 to 2 psi (7 kPa to 14 kPa) the actuator moves far enough to close the inlet valve 70. Thus, prior to a flushing, water is contained at a pressure of about 1 psi (7 kPa) in the water units.

When the water source is filled with water at 1 psi (7 kPa), both diaphragm devices are in the downward position shown for the diaphragm device 54 of FIG. 3. A diaphragm piston member 90 is attached to the middle portion 92 of each diaphragm device. A compression coil spring 94, 96 presses upwardly against each diaphragm piston member 90. The upward force applied by each spring is sufficient to pressurize the water in the regions 60, 62, 63 to about 1 psi when each spring is fully compressed, as shown for spring 94. As a result, each unit holds water under a pressure greater than that resulting from its height, so each unit holds water under pressure. When the flush valve is opened, the spring maintains a large pressure on the water, which decreases as the springs expand. However, during the time when most of water flowing through the flush valve flows through it, the water in the container is at a substantial average pressure of more than six inches (15 cm) of water and usually over twelve inches (30 cm) of water, so there is a forceful outflow of water.

As mentioned above, the particular toilet shown is a vacuum assist type. The air chamber region 66 of one of the units 44 is connected through a vacuum outlet 100 to a vacuum conduit 102 that connects to the toilet bowl outlet 24 (FIG. 1) to apply a vacuum that helps draw out water and debris from the toilet bowl. The other unit 42 has a vacuum nipple 104 which may be open to the atmosphere, so the unit 42 does not apply any vacuum to the vacuum conduit 102. It may be thought that it is desirable to apply as great a vacuum as possible to the toilet bowl outlet. However, applicant has found that a certain vacuum level is desirable, and a higher level than that is undesirable. As a result, applicant can use a second spring 96 which applies a smaller force to the diaphragm device when the second water region 62 is filled with water, than the force applied by the first spring 94. The force applied by the second spring 96 is chosen to produce the proper level of vacuum.

Figure 7:
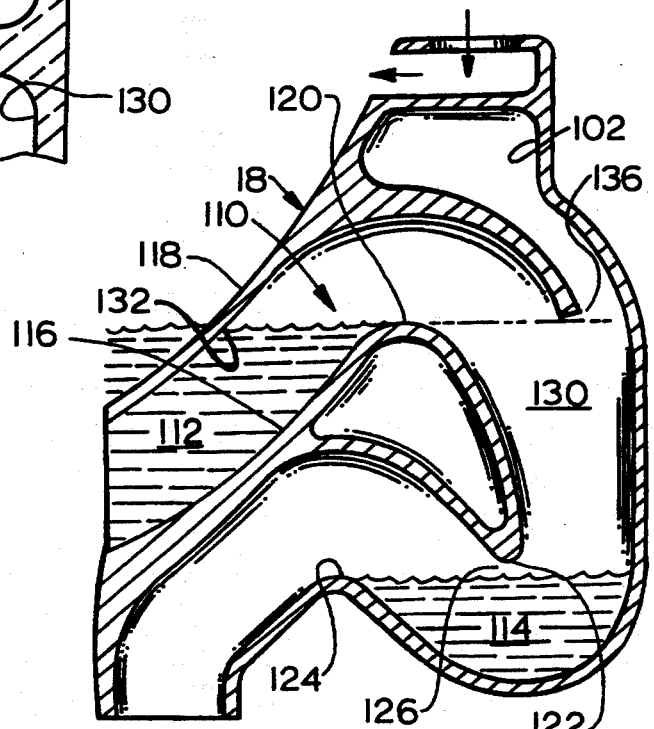
FIG. 7 is a sectional view of the toilet bowl outlet, taken on the line 7—7 of FIG. 5.

FIG. 7 illustrates details of the toilet bowl outlet 110 that carries water and waste from the toilet bowl to the drain. The toilet bowl outlet includes upper and lower traps 112, 114 that are constructed as shown. The outlet includes inner and outer walls 116, 118. The location 120 at the top of the inner wall at the upper trap 112 is high enough so the upper trap is always sealed. The top location 122 of the inner wall at the lower trap lies slightly above the top 124 of the outer wall downpath thereof, so there is a gap 126 in the lower trap, that is filled only during a flushing when water rapidly flows through the toilet bowl outlet. (It is possible to use a lower trap that is always blocked by water, and an air bypass valve which is closed only during a flushing.) A trapway 130 extends between the upper and lower traps, with the outer wall of the trapway extending from the location 132 to the top of the pool 114. The vacuum conduit 102 has a lower end at 136, where it is connected to the trapway 130. It is desirable to apply a vacuum of between about 3.5 and 4 inches water (about 10 cm of water) to the trapway during a flushing. Applicant finds that if the vacuum is greater than about five or six inches of water (12.7 cm or 15.24 cm of water) that the vacuum tends to draw out water and heavy particles in the toilet bowl, while leaving behind light particles. Of course, it is desirable to flush out all particles in the toilet bowl, including those that float in water. By controlling the vacuum so it is less than about six inches (12.5 cm) of water but at least 3 inches (7.6 cm) of water, applicant obtains a vacuum level that results in efficient low water flushing.

FIG. 2 is a chart that shows variations in water flow rate and vacuum level during a flushing. Graph 140 shows the variation in flow rate of water out of the flush valve, with time, during a flushing. It can be seen that the flow rate rapidly increases from zero to a peak in about 0.5 second, and gradually decreases until, at about two seconds the flow rate suddenly drops, with slight flow continuing until about 2.2 seconds, when it suddenly stops. Graph line 142 shows the outflow of water due to the first water supply unit. Its outflow begins at the beginning of a flushing and terminates at about two seconds, when the first diaphragm is bowed to a fully upward position. Graph line 144 shows the flow rate due to the second water supply unit. It can be seen that the flow rate is less than for the first mechanism, due to the second unit having a "softer" spring. The softer spring is used in the second mechanism to reduce the level of vacuum applied to the toilet bowl outlet. The output from the second unit ends at about 2.2 seconds, when the flush valve closes. The small flow between two seconds and 2.2 seconds, does not substantially aid in flushing, although it can help refill the toilet bowl However, since toilet bowl refill is achieved by the inlet valve, which supplies water through refill line 148 (FIG. 3) to the flush conduit, the second unit can be stopped after two seconds by placing a stop that prevents the second diaphragm device from moving to its fully upward position.

Graph line 146 in FIG. 2, represents the variation in vacuum level with time, in the trapway of the toilet bowl outlet. Until about 0.5 second after the flush valve is opened, the lower trap is open and no vacuum exists thereat. Also, the diaphragm device of the second unit does not start moving to create a vacuum until about 0.5 second when the lower trap is substantially sealed. After about 0.5 second, water flowing down through the lower trap seals it and the second unit begins to apply a vacuum, so the vacuum level rapidly rises to about 3.5 to 4 inches (9 cm to 10 cm) of water. The vacuum decreases somewhat until, at about two seconds, when the flow rate has greatly decreased, the lower trap opens and the vacuum in the trapway drops to zero. As discussed above, the use of two separate water supply units enables one of them to use a spring that applies a large force to rapidly deliver water to the toilet bowl at the beginning of a flushing. The other spring can be softer, so it applies less force in its fully compressed state. As a result, the second unit begins to apply a vacuum only an appreciable time after water starts flowing into the toilet bowl, when the lower trap is sealed, and applies a moderate vacuum level.

It is generally desirable that a considerable vacuum not be applied to the lower trap before it is closed (it is usually closed by the flow of flush water therethrough). Such early vacuum application can delay closing of the lower trap. Also such early vacuum application wastes the vacuum, which is most important in gravity toilets of the type described in my U.S. Pat. No. 5,142,712, where a limited vacuum volume is available. The softer spring in the second unit, which is the only unit that applies a vacuum, results in the second diaphragm device beginning to move up and create a vacuum, only after the first diaphragm device has moved up considerably and begins to apply a smaller pressure to the water.

The toilet bowl outlet 18 shown in FIG. 7 is substantially the same for a gravity toilet of the type described in my U.S. Pat. No. 5,142,712, as for the pressured water toilet described above. The same limitations on vacuum level and time of application of the vacuum apply for both types of toilets. That is, the sustained vacuum level (for at least about one second) which is maintained after the lower trap is closed, is preferably between 3 inches and 6 inches (7.6 cm and 15.2 cm) of water, and more preferably between 3.5 inches and 5 inches (8.9 cm and 12.7 cm) of water. Substantial vacuum ( which would apply at least 3 inches or 7.6 cm of water if the lower trap were closed) is preferably not applied to the trapway until the lower trap is closed.

Figure 5:
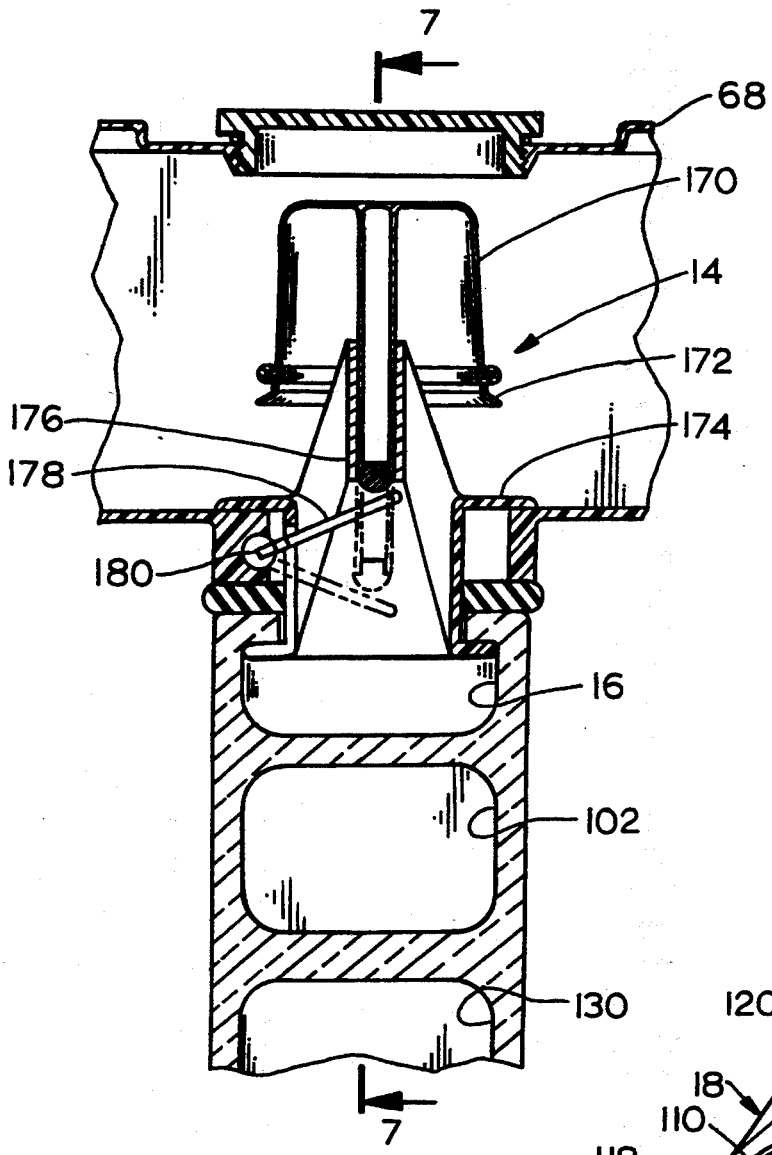
FIG. 5 is a sectional front view of the flush valve device of the water source of FIG. 1, with the float in an open position.

FIG. 5 illustrates some details of the flush valve 14, and shows the cross section of the water transfer tunnel 102, and part of the trapway 130. The float includes a seal 172 which seals against a flush valve seat 174. When the valve is in a down position, wherein it is closed, a downward extension 176 of the float lies under an actuator rod 178 which is pivotally mounted on a shaft 180. When a person operates the flush valve, as by pivoting down a lever or pushing a button, he causes the shaft 180 to pivot to the up position to raise the float 170. The float 170 thereafter remains floated to its upward position, until the level of water around it drops to a low position, when the float then drops to its closed position.

Figure 6:
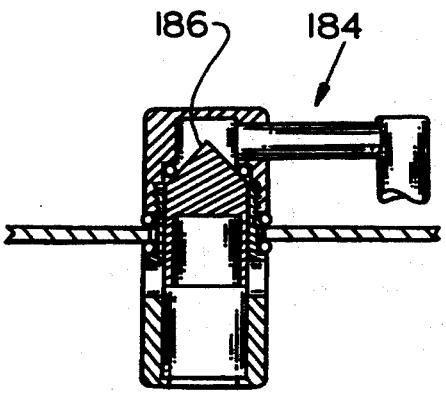
FIG. 6 is a sectional view of the vent valve of the water source of FIG. 1, shown in a closed position.

FIG. 6 shows details of a vent valve 184 which connects the upper end of the valve box to the upper end of the enclosure which contains water under pressure. The vent valve includes a vent valve float 186 which floats on water in the water enclosure. If significant air creeps into the top of the water enclosure, then the float 186 will drop far enough to allow such air under pressure to pass by the float 186 and exit through the valve box (which is vented to the atmosphere).

The above water source with two water supply units, is usually used with both mechanism operating during each flushing. It is possible to use only one mechanism during a flushing, as where only urine but not solid waste is present. However both mechanisms will be used at least some and usually most if not all of the time.

Instead of using springs to bias the diaphragm device, it is possible to use a weight mounted on the center portion of the diaphragm device, although with such a weight the water source must be oriented upside-down from the orientation of FIG. 3. When springs are used to bias the diaphragm devices, the water source can be used in any orientation. However, applicant prefers that the axes 192, 194 of the holes 50, 52 where the peripheries of the diaphragms lie, extend substantially vertically to produce a symmetrical load on the diaphragm device. It is possible to use sliding pistons instead of bellows or diaphragms, so they are the equivalent, although pistons are more prone to leakage and seizing in place. Although the flush valve device preferably includes a single flush valve, it is possible to use a separate flush valve for each unit.

Applicant has designed a toilet with water source of the illustrated construction. The water source had an overall height A (FIG. 3) of 10.12 inches (25.7 cm). The lower portions of the units can lie on opposite sides of the water tunnel 16, vacuum conduit 102, and the upper walls of the toilet bowl outlet 24. As a result, the water source extends by a height H of only 4.12 inches (10.5 cm) above the lower surface of the mount plate 46. It is noted that while it is often preferable to use a toilet bowl outlet 24 of round cross-section, applicant uses a rectangular cross-section (whose width of 2.75 inch or 7 cm is less than twice its height of 2.5 inch or 6.3 cm) to ease construction and reduce toilet height.

The outlet 24 has a width B of 2.75 inches (7 cm) which is less than twice its minimum depth C (FIG. 7) of 2.5 inch (6.3 cm). Each diaphragm has a maximum effective diameter E of 5.5 inch (14 cm), and effective cross-sectional area of 27.5 square inches (196 $cm^2$). The first spring 94 applies a maximum force of about 20 pounds, while the second spring 96 applies a maximum force of about three-quarters as much. The second spring can be chosen to have a force, when fully compressed, which produces the desired delay, such as 0.5 second, before the second diaphragm begins to move up and create a vacuum. A vacuum relief valve 196 is used, which can open to admit air when the vacuum exceeds a predetermined level such as 5 inches of water, so the maximum vacuum level is controlled separately from the time of onset of the vacuum. The overall height of the toilet bowl, from the floor to the plate of the water source was 14.62 inch (37 cm).

Figure 8:
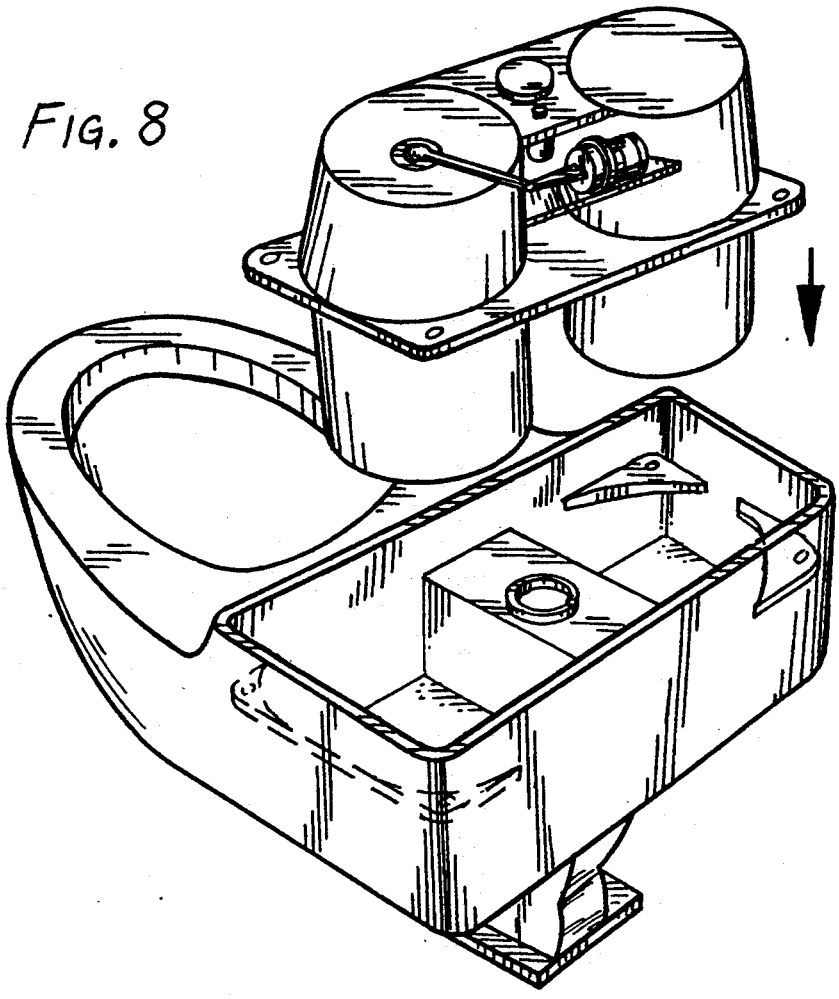
FIG. 8 is an exploded rear isometric view of a toilet constructed in accordance with another embodiment of the invention.
Figure 9:
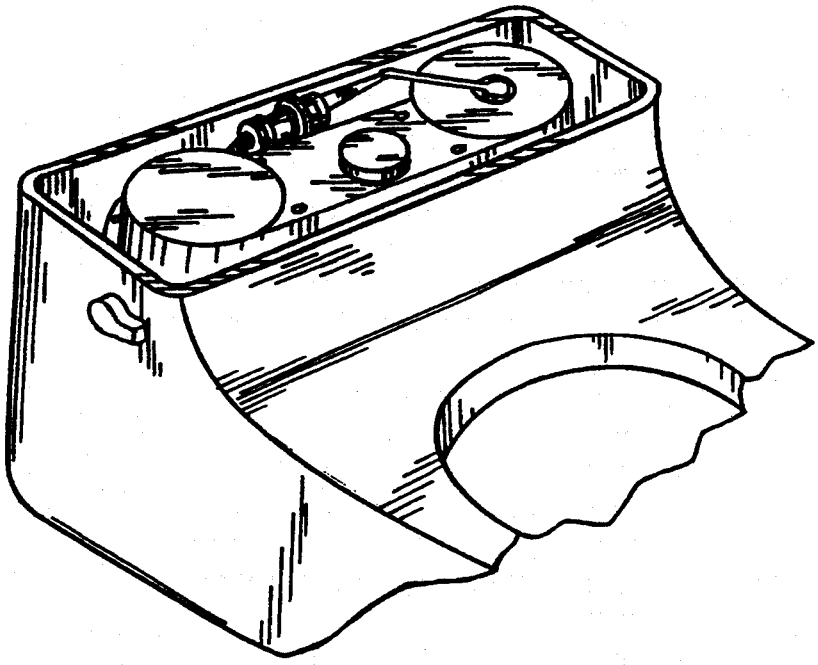
FIG. 9 is a partial isometric view of the toilet of FIG. 8, with the water-and-vacuum source installed on the toilet bowl housing.

FIG. 8 illustrates another water-and-vacuum source 200 which can be installed in a tank portion 202 of a toilet bowl housing 204 which includes the tank and a toilet bowl 206. As with the embodiment of FIGS. 1–7, the water source 200 includes two units 210, 212 whose lower portions rest on opposite sides of the toilet bowl outlet 214.

FIG. 13 shows details of one of the units 210, wherein the water chamber 216 lies under the air or vacuum chamber 218. A diaphragm device 220 can move between the extreme position 220 and 220A. At the position 220A, water fills the water chamber, while at position 220 the air chamber is in its fully expanded position. An elongated, narrow tension coil spring 222, is coupled to a plate 224 that lies against the middle of the diaphragm device, to urge the diaphragm device downwardly to pressurize the water. The coil spring has a middle 223 that extends about a pulley 224 which is rotatably mounted on a pair of plates 226 that lie within opposite sides of the unit. A highly flexible plastic rod 230 extends within the coil spring, with one end 232 of the rod fixed to the diaphragm device plate 224, and the opposite end 234 of the rod being free to move up and down within the coil spring. The rod enables the coil spring to readily move about the pulley. The end of the coil spring opposite the diaphragm device is attached by a bracket 236 to the water source frame 238. The figure shows a weight at 239 in phantom lines, which could be used instead of the spring. The middle of the diaphragm plate of the other unit 212 has an upward extension indicated at 235 which operates the inlet valve to close it when the water chamber is full.

Figure 11:
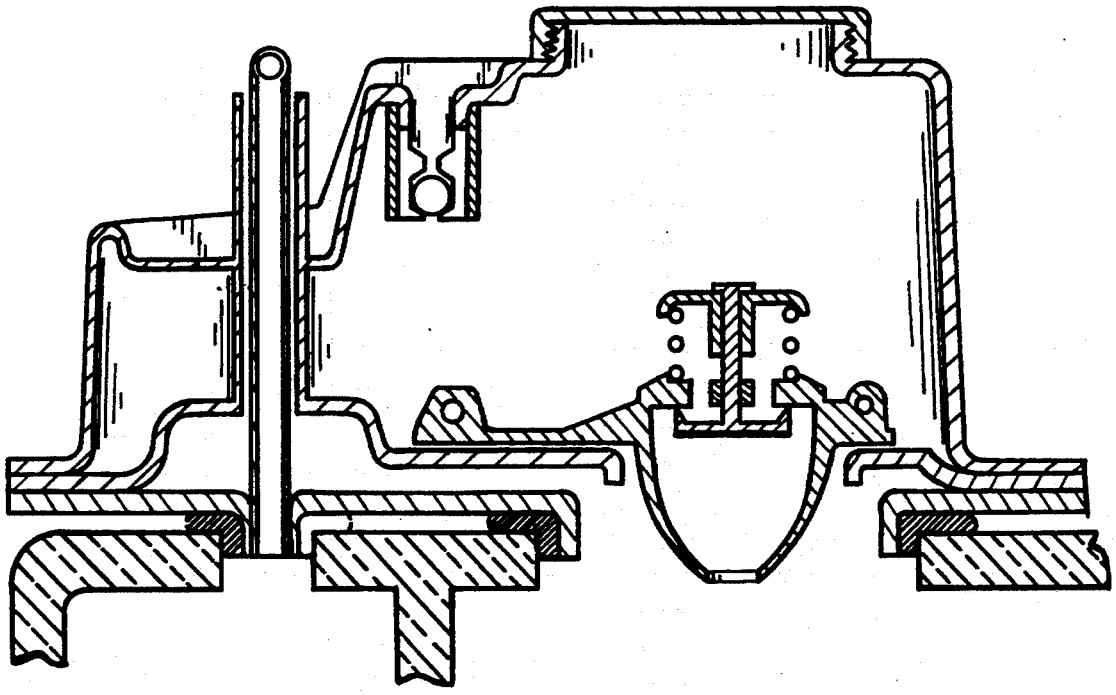
FIG. 11 is a sectional view taken on the line 11—11 of FIG. 10.

The air chamber 218 of the two units are connected together by a vacuum tube 240. The vacuum tube connects to a vertical tube 244 shown in FIG. 11. The vertical tube 244 extends down to a vacuum chamber 246 which connects to the trapway (such as 130 in FIG. 7) of the toilet bowl outlet. It is noted that the vacuum chamber 246 which connects to the toilet bowl outlet, lies rearward of the water tunnel 248 in this embodiment of the invention. FIG. 11 also shows a vent valve 250 which seals the water-holding region 252 against the outflow of water, but which can allow air to move in and out of the region until water reaches the level of a float 254 which then rises and closes the valve.

The toilet is flushed when a person operates manually-operated flushing device 258 as by depressing a flush lever or button. The lever or button presses down on a location 260 of a cam 262 which is pivotally mounted at 264. When the location 260 is pushed down to turn the cam, a chain 266 wraps about the cam and lifts an outer end 270 of a flush valve member 272 of a flush valve device 274. The flush valve member pivots about its inner end 276 to lift off a valve seat 278. It is noted that the cam 262 is offset from the valve member to avoid interference.

Figure 10:
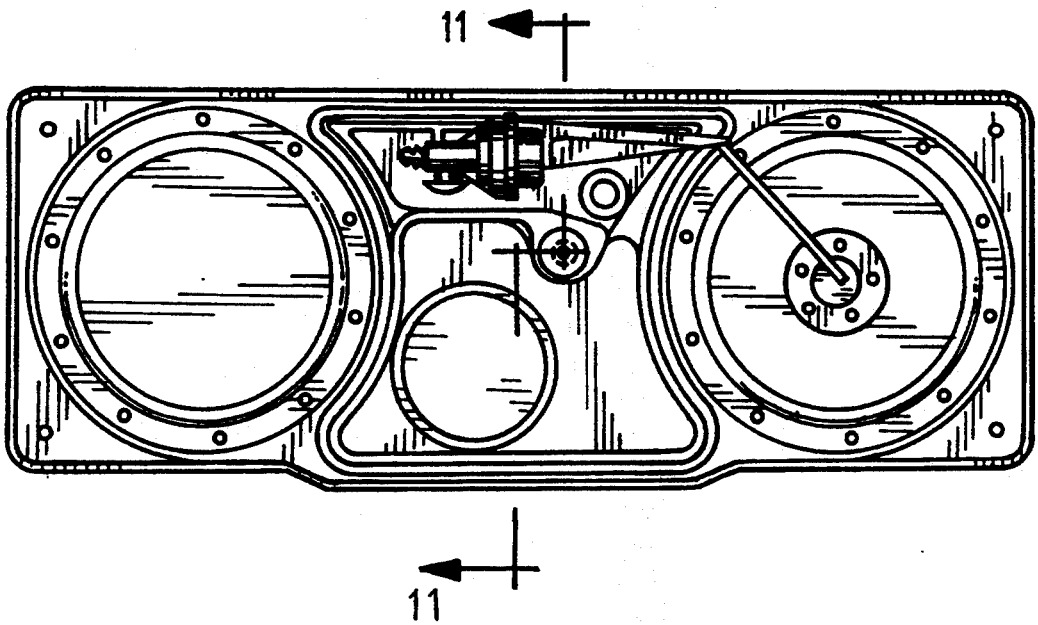
FIG. 10 is a plan view of the water-and-vacuum source of the toilet of FIG. 9.

If the inlet valve (280 in FIG. 10) should malfunction and not turn off at a predetermined pressure (e.g. 1 psi) then the pressure of water in the region 252 (FIG. 11 ) could increase to a level at which it would burst the enclosure and allow water to spill onto the bathroom floor. To prevent this, applicant constructs the flush valve member with a pressure release valve 282. The pressure relief valve includes a relief valve member 284 which is pressed downwardly by the pressure of water within the region 252, and which is pressed upwardly by a spring 286. The spring 286 is precompressed so that the relief valve member 284 moves downwardly to open the relief valve, when the water pressure in the region 254 reaches a predetermined level such as 2 psi. Water passing through the relief valve 282 moves into the water tunnel 248 to flow to the toilet bowl, and from there to the drain. By placing the relief valve 282 on the flush valve member 272, applicant discharges the water through the same hole in the valve seat 278 through which flush water normally passes. As a result, no additional hole has to be formed to communicate with the water tunnel 248.

FIG. 12 shows that the flush valve member 272 is initially opened by peeling back its outer end 270 along the flush valve seat 278; that is, by progressively bending its outer end, preferably by a total of more than 10°, to progressively lift locations along the outer end off the valve seat. The outer end 270 of the valve member is formed of soft flexible and preferably elastomeric material without any bracing that would prevent it from readily bending as shown in FIG. 12. When a rod or chain 266 lifts the outer end 270, the outer end is therefore peeled away from the valve seat. The rest of the valve member 272 does not initially lift off the valve seat because the pressure of water above the valve member is greater than the atmospheric pressure of air below the valve member. Once the outer end 270 is peeled back far enough, it allows water to flow past the valve seat as indicated by arrow 290. This flow decreases the pressure difference across the valve member and makes it easier to then lift the valve member. In prior flush valves, the outer end of the valve member was substantially rigidly fixed to the float 292 of the valve member, so they lifted together. With the relatively high pressure of water (e.g. 1 psi=2.3 feet or 70 cm of water head) considerable lifting force is required to lift the flush valve member off the valve seat. By providing a peeling action, the force required to lift the valve member and flush the toilet is reduced.

FIG. 14 is a simplified sectional view of the toilet of FIG. 8, shown during a flushing, when a vacuum is applied to the vacuum chamber 246 and the last of water is flowing out of the water holding region 252 to the toilet bowl 206.

Thus, the invention provides a water source for a toilet, which supplies an adequate volume of water under sufficient pressure to vigorously flush a toilet, and which can fit into a limited space of low height above the level of the toilet bowl in a region of limited depth behind a toilet bowl. The water source includes two pressured water supply units, each unit including a diaphragm device which is biased to compress water in an enclosure, to thereby provide water under sufficient pressure to vigorously flush a toilet, without requiring a tall tank behind the toilet bowl. The lower ends of the units lie on opposite sides of the upper part of the toilet bowl outlet. The water source is especially useful in a vacuum assist toilet to apply a controlled amount of vacuum to the trapway of the toilet bowl outlet. The water-and-vacuum source is constructed to apply a vacuum intensity within predetermined limits of 3 inches to 6 inches (7.6 cm to 15.2 cm) of water, for both gravity and pressured water supply toilets.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A toilet that includes a housing having a rearward portion, a forward portion that forms a toilet bowl, and a toilet bowl outlet which includes upper and lower traps and a trapway between them, comprising:

a frame for mounting on said housing rearward portion, said frame having two substantially circular wide holes each having a hole axis, and said frame forming water and air chamber regions on axially opposites sides of said holes, with at least said water chamber regions being connected together, and with at least one of said air chamber regions having a vacuum outlet connected to said trapway, and including an inlet for receiving water and an outlet for removing water from said connected water chamber regions;

two diaphragm devices, each having a periphery extending across a different one of said holes to isolate said water and vacuum chamber regions from each other, with each diaphragm device biased in a direction to compress water in one of said water chamber regions;

a flush valve coupled to said outlet, to control the flow of water out of said water regions, to flow into said toilet bowl.

2. A toilet which includes a toilet bowl, a water tunnel for passing water to said bowl, a bowl outlet for coupling to a drain, and a source of flush water which includes an inlet valve that is connectable to a pressured water supply and a flush valve device which is operable to flow water out of said source and into said water tunnel at the beginning of a flushing, characterized by:

said source of flush water includes first and second units, each unit including a water chamber region and a diaphragm device, with the diaphragm device of each unit being movable to expand and contract the corresponding water chamber region, with each diaphragm device being biased to urge contraction of the corresponding water chamber region to pressurize water therein and with said inlet valve coupled to said water chamber regions to supply pressured water thereto, after the beginning of a flushing, thus expanding said water chamber regions;

said first and second units being primarily horizontally spaced and both being coupled to said flush valve device to both supply water to said water tunnel during a flushing;

each of said diaphragm devices is oriented to move upwardly under the pressure of water in a corresponding water chamber region; and including first and second weights each lying on a corresponding one of said diaphragm devices to bias it downwardly.

3. A toilet which includes a toilet bowl, a water tunnel for passing water to said bowl, a bowl outlet for coupling to a drain, and a source of flush water which includes an inlet valve that connectable to a pressured water supply and a flush valve device which is operable to flow water out of said source and into said water tunnel at the beginning of a flushing, characterized by:

said source of flush water includes first and second units, each unit including a water chamber region and a diaphragm device, with the diaphragm device of each unit being movable to expand and contract the corresponding water chamber region with each diaphragm device being biased to urge contraction of the corresponding water chamber region to pressurize water therein and with said inlet valve coupled to said water chamber regions to supply pressured water thereto, after the beginning of a flushing, thus expanding said water chamber regions;

said first and second units being primarily horizontally spaced and both being coupled to said flush valve device to both supply water to said water tunnel during a flushing; and including first and second springs each coupled to a corresponding one of said diaphragm devices to urge it to contract one of said water chamber regions.

4. The toilet described in claim 3 wherein:

each of said springs includes a tension coil spring, and each of said units includes a frame and a pulley rotatably mounted on said frame, with the spring of each unit having a middle extending about the pulley of that unit and having first and second ends coupled respectively to the diaphragm device and to the frame of that unit.

5. A toilet which includes a toilet bowl, a water tunnel for passing water to said bowl; a bowl outlet for coupling to a drain, and a source of flush water which includes an inlet valve that connectable to a pressured water supply and a flush valve device which is operable to flow water out of said source and into said water tunnel at the beginning of a flushing, characterized by:

said source of flush water includes first and second units, each unit including a water chamber region and a diaphragm device, with the diaphragm device of each unit being movable to expand and contract the corresponding water chamber region with each diaphragm device being biased to urge contraction of the corresponding water chamber region to pressurize water therein and with said inlet valve coupled to said water chamber regions to supply pressured water thereto, after the beginning of a flushing, thus expanding said water chamber regions;

said first and second units being primarily horizontally spaced and both being coupled to said flush valve device to both supply water to said water tunnel during a flushing;

said units lie on opposite sides of at least a portion of said bowl outlet.

* * * * *